United States Patent [19]

Lam

[11] Patent Number: 4,555,158

[45] Date of Patent: Nov. 26, 1985

[54] MODULAR CONNECTOR AND SYSTEM CONTAINING THE SAME

[75] Inventor: Ping H. Lam, Baguio Villa, Hong Kong

[73] Assignee: The Wallace Companies, Inc., Birmingham, Ala.

[21] Appl. No.: 712,620

[22] Filed: Mar. 18, 1985

Related U.S. Application Data

[63] Continuation-in-part of Ser. No. 638,021, Aug. 6, 1984.

[51] Int. Cl.[4] ..... H01R 4/24

[52] U.S. Cl. ..... 339/99 R; 339/274

[58] Field of Search ..... 339/97 R, 97 P, 98, 339/99 R, 274, 125 R

[56] References Cited

U.S. PATENT DOCUMENTS

| | | | |
|---|---|---|---|
| 1,290,153 | 1/1919 | Fitzpatrick . | |
| 1,315,317 | 9/1919 | Letieco | 339/99 R |
| 1,488,636 | 5/1920 | Geiser . | |
| 2,110,513 | 3/1938 | Toelke | 339/99 R |
| 2,173,705 | 9/1939 | Benander et al. | 339/99 R |
| 2,655,639 | 10/1953 | Benander et al. | 339/99 R |
| 2,720,635 | 10/1955 | Odegaard | 339/99 R |
| 3,355,698 | 4/1965 | Keller . | |
| 3,781,767 | 12/1973 | Guthart | 339/125 R |
| 3,794,953 | 2/1974 | Malin | 339/125 R |
| 3,877,774 | 4/1975 | Dorrell . | |
| 3,976,351 | 8/1976 | Hopfe . | |
| 4,062,616 | 12/1977 | Shaffer et al. . | |
| 4,075,758 | 2/1978 | Parsons et al. . | |
| 4,129,350 | 12/1978 | Winn . | |
| 4,286,835 | 9/1981 | Admas et al. . | |
| 4,403,821 | 9/1983 | Zimmerman, Jr. et al. . | |

*Primary Examiner*—Joseph H. McGlynn

*Attorney, Agent, or Firm*—Hedman, Gibson, Costigan & Hoare

[57] ABSTRACT

Disclosed is a modular connector adapted to provide a removable electric connection between a source of electricity and electrical equipment which includes a cover operatively connected and movable relative to the base of the modular connector and containing insulation piercing means, and a cam mounted to the base including means adapted to engage a cable positioned on the base and move said cable toward said insulation piercing means. Also disclosed is a system for providing said removable electric connection including said modular connectors.

25 Claims, 11 Drawing Figures

MODULAR CONNECTOR AND SYSTEM CONTAINING THE SAME

This application is a continuation in part of Ser. No. 638,021, filed Aug. 6, 1984.

FIELD OF THE INVENTION

The present invention is directed to a modular system for providing removable electrical connection between a source of electricity, such as an electrical outlet, and electrical equipment, such as telephones, stereo systems, computers, remote-control switches and the like. The system includes a modular connector for such purposes which easily can be installed and moved to any convenient location in a home, business or institution.

BACKGROUND OF THE INVENTION

Users of electrical equipment, such as telephones, stereos, computers, remote-control switches and the like, usually are required to hire technicians to install extension lines and jacks at considerable expense. In addition, typical jacks are fixed permanently to walls and removal therefrom can result in damage to paint, wallpaper and to the walls themselves. If a change in the location of the jack is desired, a technician may be required to reinstall the jack in a different location.

It is therefore an object of the present invention to provide a modular connector which can be installed without the aid of a technician and which can also be moved to other locations conveniently.

It is another object of the invention to provide a complete electrical connection system in the form of a kit including modular connectors and cables adapted for use with the modular connectors.

SUMMARY OF THE INVENTION

In accordance with the present invention there is provided a modular system comprising a modular connector and cable adapted for use in conjunction with the modular connector to provide unlimited electrical connections between a source of electricity and electrical equipment.

The modular connector is made of a non-conductive material, such as polyvinyl chloride, and comprises a base having a pathway for the cable, a cover movable relative to the pathway of the base having piercing means for making the electrical connection between the cable and electrical equipment, and a cam mechanism for moving the cable to facilitate making the described electrical connection.

In preferred embodiment, the modular connector has a base wherein the pathway is an essentially planar surface for receiving the cable, and a cover rotatably mounted to the base between an open and closed position. The cover includes an opening for receiving a standard jack plug or the like. Within the cover is insulation piercing means comprising at least one row of insulation piercing terminals which are capable of piercing the insulation of the cable to make electrical connection with the wire conductor contained within the cable. Electrical connection means are provided between the opening of the cover and the insulation piercing terminals for electrically connecting the cable to the jack plug or the like of the electrical equipment.

The cam mechanism of the modular connector is rotatably mounted along one end of the base. The cam has an essentially planar surface and an arcuate surface preferably comprising a plurality of spaced apart grooves. The surfaces transverse the base and selectively can be moved to a position continuous with the pathway of the base.

The cover is rotatable to an open position wherein the base is exposed and the cable can be inserted along its pathway. Correspondingly, the cam preferably is rotated to a first position wherein the planar surface thereof is aligned with the planar surface of the pathway to thereby provide a continuous path on which the cable can lie essentially flat.

The cover is rotatable to its closed position covering the base and pathway which causes the insulation piercing terminals to be aligned with the cable on the pathway. With the cover closed, the cam is preferably rotated to a second position to displace its planar surface and to rotate its arcuate surface into contact with the cable. In so doing, the arcuate surface moves the cable from the pathway toward and into an engagement with the insulation piercing terminals which penetrate the insulation and contact the wire conductors therein. At such time the desired electrical connection can be established between the conductors and a jack plug or the like inserted in the cover of the modular connector.

The system of invention also can be in the form of a kit comprising at least two of the described modular connectors, a first cable for electrically connecting a source of electricity to one of the modular connectors, wherein the first cable has a standard jack plug at one end thereof for insertion into the opening of one of the modular connectors, and a second cable for electrically connecting the one modular connector to the other modular connectors.

BRIEF DESCRIPTION OF THE DRAWINGS

The following is a detailed description together with accompanying drawings of illustrative embodiments of the invention. It is to be understood that the invention is capable of modification and variation apparent to those skilled in the art within the spirit and scope of the invention.

DETAILED DESCRIPTION OF THE DRAWINGS

Figure 1:
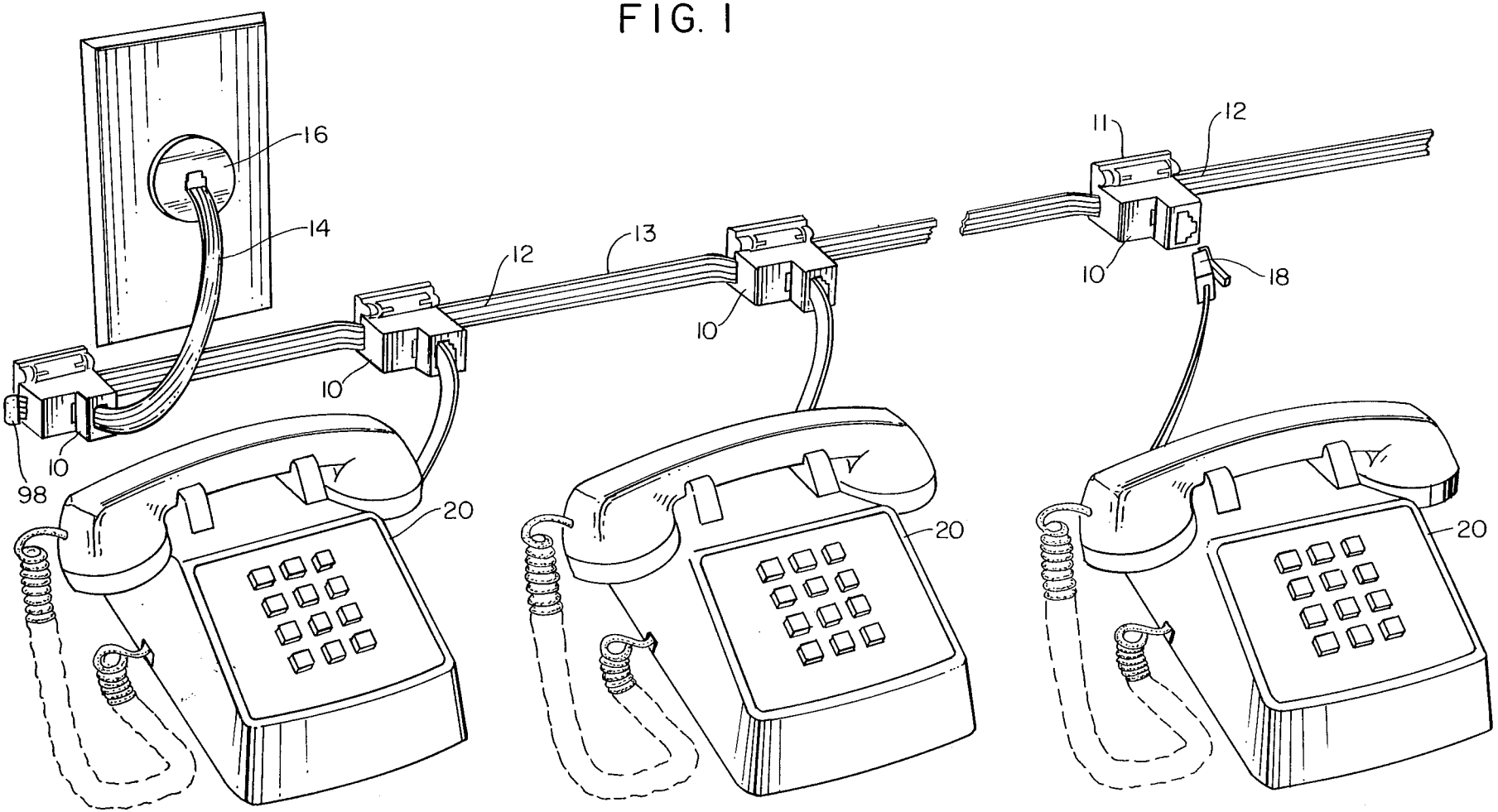
FIG. 1 is a perspective view of a preferred embodiment of the present invention for electrically connecting a source of electricity to electrical equipment, such as a telephone.

Referring to the drawings and first to FIG. 1 there is illustrated a preferred embodiment of the present invention, comprising a plurality of modular connectors 10 and a cable 12 to which the modular connectors 10 are affixed. A source cable 14 is also provided to electrically connect a source of electricity 16 (e.g. an electrical outlet) and one of the modular connectors 10. A complete electrical circuit is achieved when a standard jack plug 18 of electrical equipment 20 (e.g. a telephone) is inserted into modular connector 10 to provide electrical connection therewith.

Figure 2:
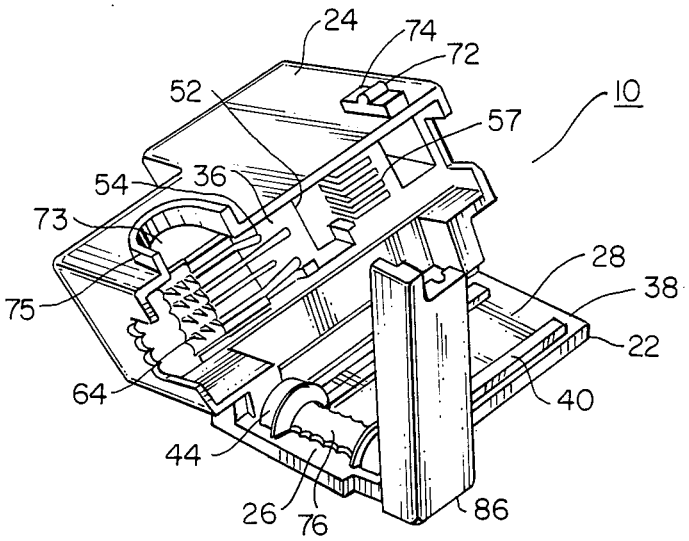
FIG. 2 is a perspective view of a modular connector of the system in the open position ready to receive a cable.
Figure 3:
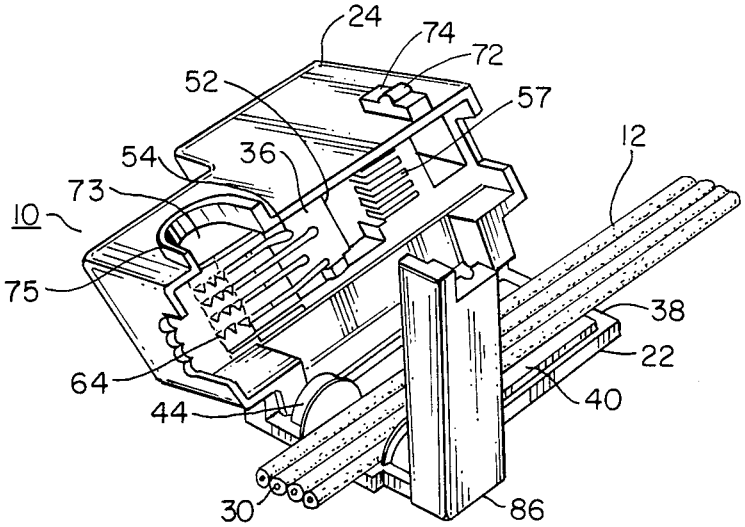
FIG. 3 is the opened modular connector of FIG. 2 after it has received the cable.
Figure 4:
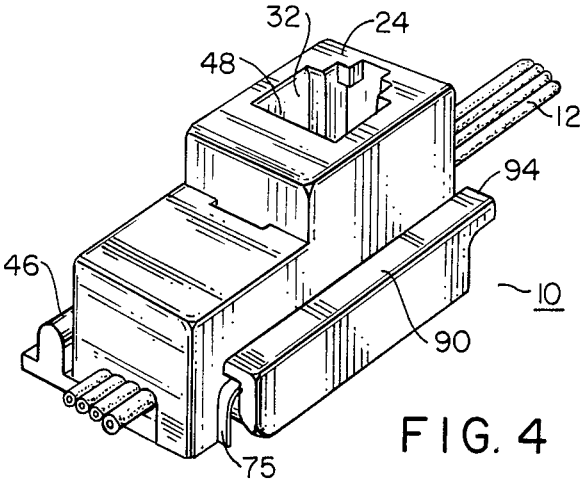
FIG. 4 is a perspective view of the modular connector of FIG. 2 in the closed position providing the electrical connection with the cable.

As shown in FIGS. 2–4, the modular connector 10 includes a base 22, and a cover 24 and cam mechanism 26, both of which are rotatably mounted to the base 22.

The base 22 includes a pathway 28 for positioning the cable 12 thereon with insulated conductors 30 therein. The cover 24 includes an opening 32 for the jack plug 18 of the telephone 20, insulation piercing terminals 34 for piercing the cable 12 to make electrical contact with conductors 30 and an electrical connecting means 36 between the insulation piercing terminals 34 and the opening 32.

The cam mechanism 26 is movable between two positions. In a first position, the cam mechanism 26 facilitates positioning of the cable 12 on the pathway 28, and, in a second position, raises a portion of the cable 12 from the pathway 28 to facilitate piercing of the cable 12 which provides the electrical connection between the conductors 30 and the jack plug 18 inserted within the opening 32.

Figure 5:
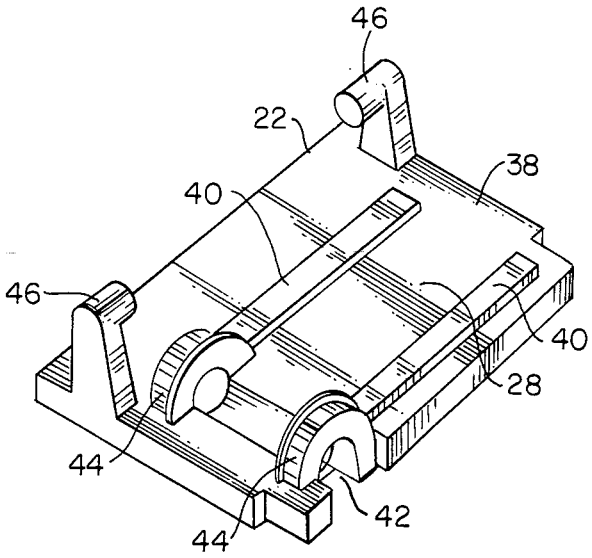
FIG. 5 is a perspective view of the base of the modular connector.

Referring to FIG. 5 the base 22 has a generally rectangular configuration and comprises a flat or planar surface 38 including a flat or planar pathway 28 formed by parallel spaced apart raised guides 40 which extend along a substantial portion of the length of the base 38. At one end of the spaced apart guides 40 is a channel 42 transverse to the pathway 28 and arches 44 are positioned at opposed ends of the channel 42. The channel 42 and arches 44 are for receiving the cam mechanism 26 and for transversely positioning it contiguous with the pathway 28.

The base 22 also comprises a pair of opposed pivot arms 46 for engaging the cover 24 to provide a rotatable connection therewith.

Figure 8:
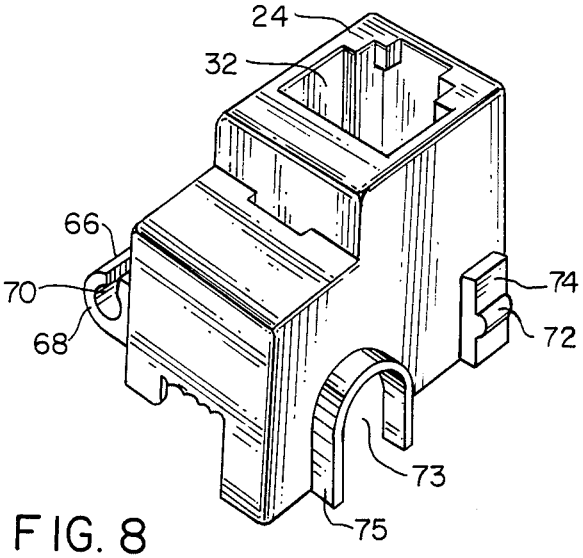
FIG. 8 is a perspective view of the cover of the modular connector.

Referring to FIGS. 1–4 and 8, the cover 24 comprises the opening 32 having a shape complementary to the standard jack plug 18 for providing removable electrical connection therewith. As shown in FIG. 8 the opening 32 is positioned at the top surface of the cover 24. It should be understood that the opening 32 could be positioned in another portion of the cover 32, e.g. in a side of the cover.

Figure 10:
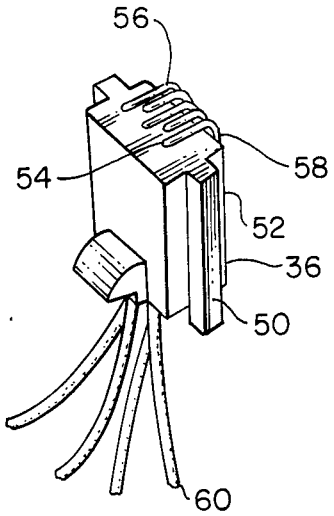
FIG. 10 is a perspective view of the electrical connection means between the opening in the modular connector and the insulation piercing terminals.

The cover 24 also comprises the insulation piercing terminals 34 and the electrical connecting means 36 to electrically connect the jack plug 18 to the cable 12 via the insulation piercing terminals 34. Referring to FIG. 10, the electrical connecting means 36 comprises a housing 50 having a side 52 which forms an inside wall 48 of the opening 32 and passageways 54 longitudinally disposed within the side 52 for receiving conductors 56 therein. One end 58 of the conductors 56 extend out of the top of the passageways 54 and down into the opening 32. The end 58 of the conductors 56 are secured in the slots 57 positioned toward the bottom of the opening 32 as shown in FIGS. 2 and 3.

Jack plug 18 has similar conductors which are adapted to contact conductors 56 when the jack plug 18 is inserted into the opening 32 as shown in FIG. 1.

Preferably the portion of the conductors 56 within the passageways 54 is surrounded by insulation to prevent cracking of the conductors 56. The other end 60 of the conductors 56 extends from the bottom of the passageways 54 to the insulation piercing terminals 34 where they are connected thereto.

Figure 9:
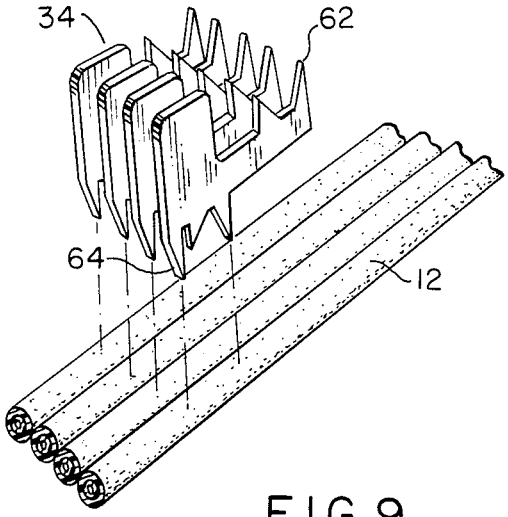
FIG. 9 is a perspective view of the insulation piercing terminals of the modular connector shown piercing the insulation and contacting the conductors within the cable.

Referring to FIG. 9 the insulation piercing terminals 34 comprise at least one row of posts 62 and teeth 64. The end 60 of the conductors 56 are secured to the posts 62 by winding or other suitable means to provide electrical connection therewith. The teeth 64 in each row extend toward the cable 12 when the same is loaded in modular connector 10 and the cover 24 is in the closed position. The teeth 64 may be aligned with each other or, preferably, are out of alignment. The teeth 64 of each row may also have different lengths to insure proper electrical connection with the cable 12 as more fully described below.

Referring to FIG. 8, the cover 32 further comprises a rotatable connection means 66 for engaging the pivot arms 46 of the base 22 to provide rotatable connection therewith. The rotatable connection means 66 comprises an annular frame 68 forming a channel 70 into which rests the pivot arms 46.

There also is provided on a wall of the cover 32 a projection 72 mounted on a platform 74 for locking the cam mechanism 26 in the cable piercing mode as more fully described below. On the same wall is a U-shaped cut out 73 having a ledge 75 through which a portion of the cam mechanism 26 is inserted.

Figure 6:
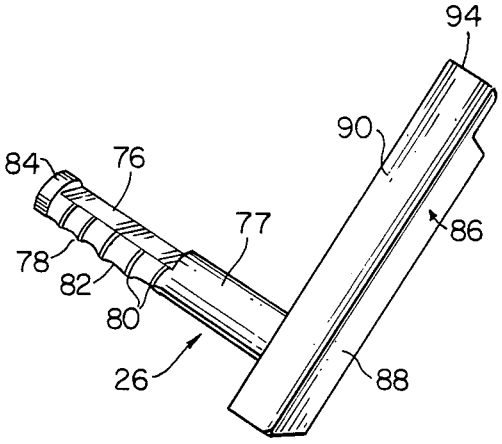
FIG. 6 is a perspective view of the rotatable cam and handle of the modular connector.
Figure 7:
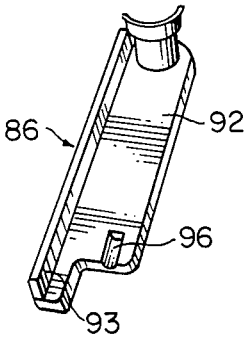
FIG. 7 is a perspective view of the inside surface of the handle.

Referring to FIG. 6 the cam mechanism 26 comprises a substantially tubular arm 77 having a planar surface 76 and an arcuate surface 78 having at least one pair of spaced apart ridges 80 forming grooves 82 therebetween. The cam 26 terminates at an end piece 84 which rotates within the portion of the channel 42 formed below the innermost arch 44 on the base 22. As shown in FIG. 2 the planar surface 76 and the arcuate surface 78 are transverse and contiguous with the pathway 26.

The cam 26 is connected at the end remote from end piece 84 to the base of a generally L-shaped handle 86 which has a front surface 88 an upper surface 90 and corresponding inner walls 92 and 93. A lip 94 is provided at the other end of the handle 86.

At the base of the handle 86, the inner walls 92 and 93 engage the corresponding surfaces of the ledge 75 to limit the insertion of arm 77 into the channel 42 to facilitate rotation of the handle 86 as it rotates the arm 77 of the cam 26. In practice when the handle 86 is rotated between desired positions the surfaces of the ledge 75 generally remain in contact with the corresponding innerwalls 92 and 93 of the handle 86. Moreover, inner wall 92 at the outer end has an aperture 96 for engaging the projection 72 to thereby removably lock the cam 26 in place.

The cable 12 as shown in FIG. 3 comprises at least one, preferably a plurality of insulated conductors 30. Each of the insulated conductors 30 has a radius of curvature corresponding to the curvature of the groove 82 so that it may rest in a groove 82 formed in arcuate surface 78 of the cam 26.

The operation of the modular connector 10 to provide an electrical connection with the cable 12 is accomplished by rotating the cover 24 about the base 22 as shown in FIG. 2 to thereby expose the pathway 28 on the base 22. Before loading the cable 12 thereon the handle 86 of the cam 26 is turned about the ledge 75 to the upright position which causes the cam 26 to rotate so that its planar surface 76 is aligned with the pathway 28 to provide a continuous surface on which the cable 12 rests. The cable 12 is then placed on the pathway 28 as shown in FIG. 3.

The cover 24 is then rotated to the closed position as shown in FIG. 4 with the handle 86 still in the upright position as shown in FIG. 3. Rotation of the cover 32 aligns the rows of teeth 64 of the insulation piercing terminals 34 with corresponding insulated conductors 30 of the cable 12. The handle 86 is then turned to the locked position as shown in FIG. 4 by applying downward pressure to the upper surface 90. This causes the cam 26 to rotate so that the grooves 82 of the arcuate surface 78 contact the underside of the cable 12 and lifts the individual insulated conductors 30 toward the teeth 64. The arcuate surface 78 lies above the plane of the pathway 28 when the handle 86 is turned to the locked position which causes the cable 12 to be lifted upward toward the teeth 64 of the insulation piercing terminals 34. Locking of the handle 86 is accomplished when the aperture 96 in the inner wall 92 engages the projection 72 on the cover 24. As a result, the insulated conductors 30 are moved upward toward the teeth 64 which penetrate the insulation and make an electrical connection with the insulated conductors 30.

The modular connector 10 may be disengaged from the cable 12 by reversing the operation. More specifically, the handle 86 is released from the locked position by lifting at the lip 94 to disengage the projection 72 from the aperture 96. The handle 86 is turned counterclockwise to the upright position causing the cam 26 to rotate so that the planar surface 76 engages the underside 13 of the cable 12. The pressure applied to the cable 12 to force contact with the insulation piercing terminals 34 during the electrical connection operation is relieved because the underside 13 of the cable 12 is caused to rest on the planar surface 76. Complete disengagement is accomplished by rotating the cover 24 to the open position as shown in FIG. 3. The modular connector 10 can then be disengaged from the cable 12 and removed from the system or engaged with the cable 12 at a different location.

As previously described the teeth 64 of each row of the insulation piercing terminals 34 are preferably out of alignment with each other and have different lengths. This configuration is advantageous because it provides greater assurance that at least one of the teeth 64 of each row will penetrate the insulated conductor 30 to provide electrical connection therewith.

The modular connector 10 and the cable 12 can be affixed to a suitable substrate such as a wall in a suitable manner such as by brackets, clips, etc. Preferably as shown in FIG. 1 the wall facing surface 11 of the modular connector 10 and the underside 13 of the cable 12 are each provided with an adhesive coating which enables removable adhesive contact with the substrate. Suitable adhesives are known to those skilled in the art. Particularly preferred is a double faced tissue tape.

Figure 11:
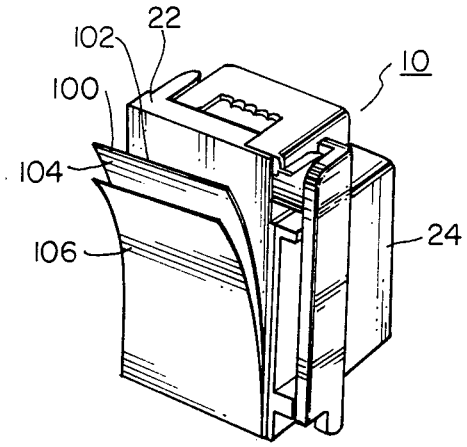
FIG. 11 is a bottom view of the base of the modular connector illustrating an adhesive coating thereon protected by a peelable coated paper.

Referring to FIG. 11 the inner surface 102 of the tape 100 is coated with a high performance pressure sensitive adhesive for bonding to the modular connector 10 typically made of polyvinyl chloride. The outer surface 104 of the tape 100 is coated with an acrylic based pressure sensitive adhesive for bonding to a substrate such as a wall or a floor. As is customary in the art, the adhesive coating on the outer surface 104 of the tape 100 is protected by a peelable layer 106 such as coated paper until ready for use.

The ends of the cable 12 should be protected to avoid contact with exposed conductors within the cable 12. This can be routinely accomplished by placing a protective cap 98 over the exposed conductors of the cable 12 as shown in FIG. 1.

The cable 12 may be laid along a wall or on the floor. A modular connector 10 is affixed to the cable 12 in proximity to the outlet 16 and electrical connection is made by inserting one end of the source cable 14 into the outlet 16 and the other end having thereon a standard jack plug 18 into the opening 32 of the first modular connector 10 as shown in FIG. 1. Other modular connectors 10 are then affixed to the cable 12 as previously described in whatever location of a room is deemed desirable. A piece of electrical equipment 20 such as a telephone having a jack plug 18 affixed thereto is then inserted into the opening 32 of a modular connector 10 to complete the system.

The invention in its broader aspects is not limited to the illustrative embodiment and departures may be made therefrom within the scope of the accompanying claims without departing from the principles of the invention and without sacrificing its chief advantages.

What is claimed is:

1. A modular connector adapted to provide a removable electric connection between a source of electricity and electrical equipment, comprising:

(a) a base;

(b) a pathway on a surface of the base for receiving an insulated cable containing at least one conductor therein;

(c) a cover operatively connected and movable relative to the base, comprising an opening for receiving an electrical connector insertable therein, insulation piercing means, and electrical connecting means between said opening and said insulation piercing means adapted to electrically connect a pierced cable to an electrical connector inserted in said opening, said cover being movable from an open position exposing said base to a closed position for aligning said insulation piercing means with said insulated cable;

(d) a cam mounted to said base including an essentially planar surface which is alignable with said pathway to facilitate reception of the insulated cable, and a non-planar surface comprising at least one groove which surface is raised relative to said pathway for moving said cable toward said insulation piercing means when said cover is moved from the open position to the closed position to facilitate piercing thereof; and (e) means for moving said essentially planar surface out of alignment with said pathway and moving said non-planar surface adjacent said pathway.

2. The modular connector of claim 1, wherein said means for moving said cam surfaces comprises a handle having a locking means for removably locking said cam in the closed position.

3. The modular connector of claim 1 wherein said electrical apparatus is a telephone.

4. The modular connector of claim 1 wherein said cover is pivotally movable relative to said base.

5. The modular connector of claim 1, wherein said insulation piercing means comprises at least two rows of insulation piercing terminals, each of said rows having a plurality of teeth for penetrating said insulated cable.

6. The modular connector of claim 5, wherein the teeth of each row of insulation piercing terminals are out of alignment with each other.

7. The modular connector of claim 6, wherein the non-aligned insulation piercing terminals have different lengths.

8. The modular connector of claim 7, wherein said insulation piercing means comprises at least three rows of insulation piercing terminals, each row containing at least three non-aligned teeth.

9. The modular connector of claim 1, wherein said base further comprises a bottom surface having an adhesive coating thereon for mounting said modular connector to a substrate.

10. The modular connector of claim 9, wherein said cable further comprises a bottom surface, at least a portion of which has an adhesive coating for mounting said cable to a substrate.

11. A modular connector for providing a removable electrical connection between a source of electricity and electrical equipment comprising:

(a) a base;

(b) a pathway having an essentially planar surface on said base for positioning an insulated cable thereon;

(c) a cover movably mounted to the base between open and closed positions, said cover comprising an opening for providing an electrical connection with an electrical connector insertable in said opening, at least two rows of insulation piercing terminals, and electrical connection means between said opening and said insulation piercing terminals, said cover being movable from an open position exposing said pathway to a closed position for aligning said insulation piercing terminals with said insulated cable on said pathway;

(d) a movable cam mounted along one end of said base, said cam having an essentially planar surface and an arcuate surface comprising a plurality of spaced apart grooves, said cam being rotatable from a first position wherein said planar surface is aligned with said pathway to a second position wherein said arcuate surface is adjacent said pathway; and (e) rotating means for rotating said cam from said first position to said second position, wherein a removable connection between a source of electricity and electrical equipment is provided by rotating said cover to the closed position with said cable positioned on said pathway and then rotating said cam to the second position wherein the portion of the cable in contact with said arcuate surface is caused to move toward and be penetrated by said insulation piercing terminals.

12. A system for providing a removable electrical connection between a source of electricity and electrical equipment comprising:

(a) at least two modular connectors, said modular connector comprising:

(1) a base;

(2) a pathway on a surface of the base for receiving an insulated cable containing at least one conductor therein;

(3) a cover operatively connected and movable relative to the base, comprising an opening for receiving an electrical connector insertable therein, insulation piercing means, and electrical connecting means between said opening and said insulation piercing means adapted to electrically connect a pierced cable to an electrical connector inserted in said opening, said cover being movable from an open position exposing said base to a closed position for aligning said insulation piercing means with said insulated cable;

(4) A cam mounted to said base including an essentially planar surface which is alignable with said pathway to facilitate reception of the insulated cable, and a non-planar surface comprising at least one groove which surface is raised relative to said pathway for moving said cable toward said insulation piercing means when said cover is moved from the open position to the closed position to facilitate piercing thereof; and (5) means for moving said essentially planar surface out of alignment with said pathway and moving said non-planar surface adjacent said pathway;

(b) a first cable for providing electrical connection between said source of electricity and a first modular connector, said cable having an electrical connector at one end thereof for inserting into the opening of said first modular connector; and (c) a second cable for providing electrical connection between said first modular connector and said other modular connectors, by being adapted to be inserted in the pathway of said modular connectors.

13. The system of claim 12, wherein said means for moving said cam surfaces comprises a handle having a locking means for removably locking said cam in the closed position.

14. The system of claim 12, wherein the cover of said modular connector is pivotally movable relative to said base.

15. The system of claim 12, wherein said insulation piercing means comprises at least two rows of insulation piercing terminals, each of said rows having a plurality of teeth for penetrating said insulated cable.

16. The system of claim 15, wherein the teeth of each row of insulation piercing terminals are out of alignment with each other.

17. The system of claim 16, wherein the non-aligned insulation piercing terminals have different lengths.

18. The system of claim 12, wherein said base further comprises a bottom surface having an adhesive coating thereon for mounting said modular connector to a substrate.

19. The system of claim 18, wherein said cable further comprises a bottom surface, at least a portion of which has an adhesive coating for mounting said cable to a substrate.

20. The modular connector of claim 1, wherein said pathway is essentially planar, and wherein said non-planar surface of said cam is arcuate.

21. The modular connector of claim 20 wherein said arcuate surface comprises a plurality of spaced apart grooves, and wherein said insulated cable comprises a plurality of conductors, each conductor of said insulated cable being alignable with one of said spaced apart grooves.

22. The modular connector of claim 21, wherein the number of grooves corresponds to the number of conductors within said insulated cable.

23. The system of claim 12, wherein the pathway of said modular connector is essentially planar, and wherein said non-planar surface of said cam is arcuate.

24. The system of claim 23, wherein said arcuate surface comprises a plurality of spaced apart grooves, and wherein said insulated cable comprises a plurality of conductors, each conductor of said insulated cable being alignable with one of said spaced apart grooves.

25. The system of claim 24, wherein the number of grooves corresponds to the number of conductors within said insulated cable.

* * * * *

UNITED STATES PATENT AND TRADEMARK OFFICE

CERTIFICATE OF CORRECTION

PATENT NO. : 4,555,158

DATED : November 26, 1985

INVENTOR(S) : Ping H. Lam

It is certified that error appears in the above—identified patent and that said Letters Patent is hereby corrected as shown below:

On the title page, Item 22, please amend the filing date of "March 18, 1985" to read --March 15, 1985--.

Signed and Sealed this

*First* Day of *April 1986*

[SEAL]

*Attest:*

DONALD J. QUIGG

*Attesting Officer*

*Commissioner of Patents and Trademarks*